US007588076B2

(12) United States Patent
Jin

(10) Patent No.: US 7,588,076 B2
(45) Date of Patent: Sep. 15, 2009

(54) PUMPING AND REPAIRING UNIT

(76) Inventor: Chengqun Jin, No. 418, 15-7 Room, Pingquan Road, Nanguan Borough, Changchun City, Jilin Province (CN) 130022

( * ) Notice: Subject to any disclaimer, the term of this patent is extended or adjusted under 35 U.S.C. 154(b) by 168 days.

(21) Appl. No.: 11/795,452

(22) PCT Filed: Jan. 17, 2005

(86) PCT No.: PCT/CN2005/000071

§ 371 (c)(1),
(2), (4) Date: Jul. 17, 2007

(87) PCT Pub. No.: WO2006/074578

PCT Pub. Date: Jul. 20, 2006

(65) Prior Publication Data

US 2008/0128124 A1 Jun. 5, 2008

(51) Int. Cl.
*E21B 43/00* (2006.01)

(52) U.S. Cl. ..... 166/105; 417/360

(58) Field of Classification Search ..... 417/415, 417/416; 166/68.5

See application file for complete search history.

(56) References Cited

U.S. PATENT DOCUMENTS 2,681,623 A * 6/1954 Kane ..... 417/399
6,901,998 B1 * 6/2005 Roodenburg et al. ..... 166/85.1

FOREIGN PATENT DOCUMENTS

| | | |
|---|---|---|
| CN | 2258547 | 7/1997 |
| CN | 1313451 | 9/2001 |
| CN | 2601303 | 1/2004 |
| CN | 1526912 | 9/2004 |
| CN | 1529036 | 9/2004 |

* cited by examiner

*Primary Examiner*—David J Bagnell
*Assistant Examiner*—Catherine Loikith
(74) *Attorney, Agent, or Firm*—Patterson, Thuente, Skaar & Christensen, P.A.

(57) ABSTRACT

An oil machinery, that includes a pumping and repairing unit comprising: an electrically operated brake, a coupling, a speed reducer, an oil pumping polished rod, a polished rod eye for the oil pumping polished rod, an oil pumping polished rod rope, a balance weight case, a balance weight rope hanging device, a balance weight rope, a protection rope, a protection rope catching device, and a driving device. A workover rope is fixed to the driving and braking device, and has another end which is fixed to the supporting platform after it has wound around a fixed pulley block and a movable pulley block. An elevator is coupled with a lower end of the movable pulley block.

16 Claims, 4 Drawing Sheets

PUMPING AND REPAIRING UNIT

RELATED APPLICATIONS

This application claims priority to PCT Application No. PCT/CN2005/000071 filed Jan. 17, 2005, the disclosure of which is hereby incorporated by reference in its entirety.

BACKGROUND OF THE INVENTION

1. Field of the Invention

The present invention relates to oil machinery, and particularly to a pumping and repairing unit which can be used for both oil pumping and well workover.

2. Description of the Related Art

Chinese Patent No. 200310100186.X discloses a pumping and repairing unit. The pumping and repairing unit comprises a head sheave shaft, a speed reducer, a larger gear, a small gear, an electric motor, a head sheave rope, a balance weight, a balance weight frame, guiding ropes, an oil pumping polished rod, a main frame, a supporting platform and a head sheave. A rope suspension device (or a polished rod eye) has an end connected with the polished rod, and another end connected with a periphery of a drum of the head sheave through a traction rope for the rope suspension device. The balance weight is fixed to the periphery of the drum of the head sheave through the balance weight frame, a rope hanging device, and a balance weight traction rope. The motor is coupled with the speed reducer through a brake and a coupling. An output shaft of the speed reducer is coupled with the small gear which meshes with the larger gear However, in the pumping and repairing unit with such a configuration, a hoisting barrel and a hoisting rope for workover offset far away from a center of a well so that an oil pipe is bent and a traction force is insufficient in the workover. Therefore, it is difficult for the pumping and repairing unit to be used for workover. In addition, when an electrical brake is disposed only at a high-speed end of a power transmission of the pumping and repairing unit, transmission components of the power transmission are subject to huge impact during braking, resulting in reduced lifetime and deteriorated performance of the pumping and repairing unit.

SUMMARY OF THE INVENTION

It is an object of the present invention to provide a pumping and repairing unit with improved performance, which operates smoothly and reliably, and which is durable, and more convenient in use and maintenance.

The present invention provides the following solution. A pumping and repairing unit according to the present invention comprises an electrical control cabinet, a main frame, a supporting platform, a motor, an electrically operated brake, a coupling, a speed reducer, an oil pumping polished rod, a rope suspension device (or a polished rod eye) for the oil pumping polished rod, an oil pumping polished rod rope, a balance weight case, a balance weight rope hanging device, a balance weight rope, a protection rope, a protection rope catching device, and a driving device. The supporting platform is disposed on the main frame. The motor is coupled with the speed reducer through the electrically operated brake and the coupling. The speed reducer is coupled with the driving device. The oil pumping polished rod rope has an end connected with the oil pumping polished rod through the rope suspension device and another end fixed to the driving device. The balance weight rope has an end connected with a balance weight rope hanging device disposed at the balance weight case, and another end fixed to the driving device. The protection rope has an end connected with the balance weight rope hanging device, and another end which is fixed to the driving device after passing through the protection rope catching device disposed at the supporting platform. The driving device and a brake wheel disposed at an end of the driving device constitute a driving and braking device. A fixed pulley block is disposed at the supporting platform. A workover rope is fixed to the driving and braking device, and has another end which is fixed to the supporting platform after winding around the fixed pulley block and a movable pulley block. A hanging connector (or an elevator) is coupled with a lower end of the movable pulley block. A braking handle is disposed at a bottom of the main frame, and the brake wheel is controlled by the braking handle through a lever.

Balance weight guiding ropes are arranged between the bottom of the main frame and the supporting platform. Upper and lower guiding wheels are mounted to the balance weight case so as to be staggered with respect to each other. The balance weight guiding ropes are interposed between the upper and lower guiding wheels.

A ladder is mounted to the main frame.

Filler within the balance weight case can be building waste, industrial waste, water, or a mixture of building waste, industrial waste, or water Examples of building waste include sand, carpolite, clay, bricks, or concrete blocks, and examples of industrial waste include scoria, ore, or slag.

According to an aspect of the present invention, the present invention provides pumping and repairing unit, comprises: a supporting platform, a head sheave disposed on the supporting platform, a fixed pulley block disposed at the supporting platform, a movable pulley block, and a workover rope having an end fixed to a periphery of a drum of the head sheave, and another end which is fixed to the supporting platform after passing through the fixed pulley block and the movable pulley block, said workover rope being adapted to pull up an oil pipe or an oil pumping polished rod for workover.

According to the present invention, the fixed pulley block is mounted to the supporting platform; the workover rope is fixed to the driving and braking device; and the other end of the workover rope is fixed to the supporting platform after it has wound around the fixed pulley block and the movable pulley block. The hanging connector is connected to the lower end of the movable pulley block. An oil pipe or the oil pumping polished rod is pulled up by the hanging connector so as to perform the workover. A traction force for workover is considerably increased by the improved fixed pulley block and movable pulley block. In addition, because the fixed pulley block corresponds to a well head, the oil pipe is not bent during workover so that the pumping and repairing unit is convenient during workover, thereby achieving pumping oil with high efficiency and safe workover. Especially, the pumping and repairing unit has a very complete and reliable function of workover. During workover, the oil pumping polished rod and oil pipe stand beside the main frame and are surrounded by canvas or nylon cloth so that a relatively sealed space is formed. Therefore, waste is treated without environmental pollution so that the workover is environmentally-friendly. The entire process of the workover is simple and convenient in operation. In addition, the driving device and the brake wheel disposed at the end of the driving device constitute the driving and braking device; the braking handle is disposed at the bottom of the main frame; and the brake wheel is controlled by the braking handle through the level. Therefore, components for transmitting power are protected by the brake wheel disposed at the end of the driving device in workover so as to prolong life time of the pumping and repairing unit.

DETAILED DESCRIPTION OF THE EMBODIMENTS

Figure 1:
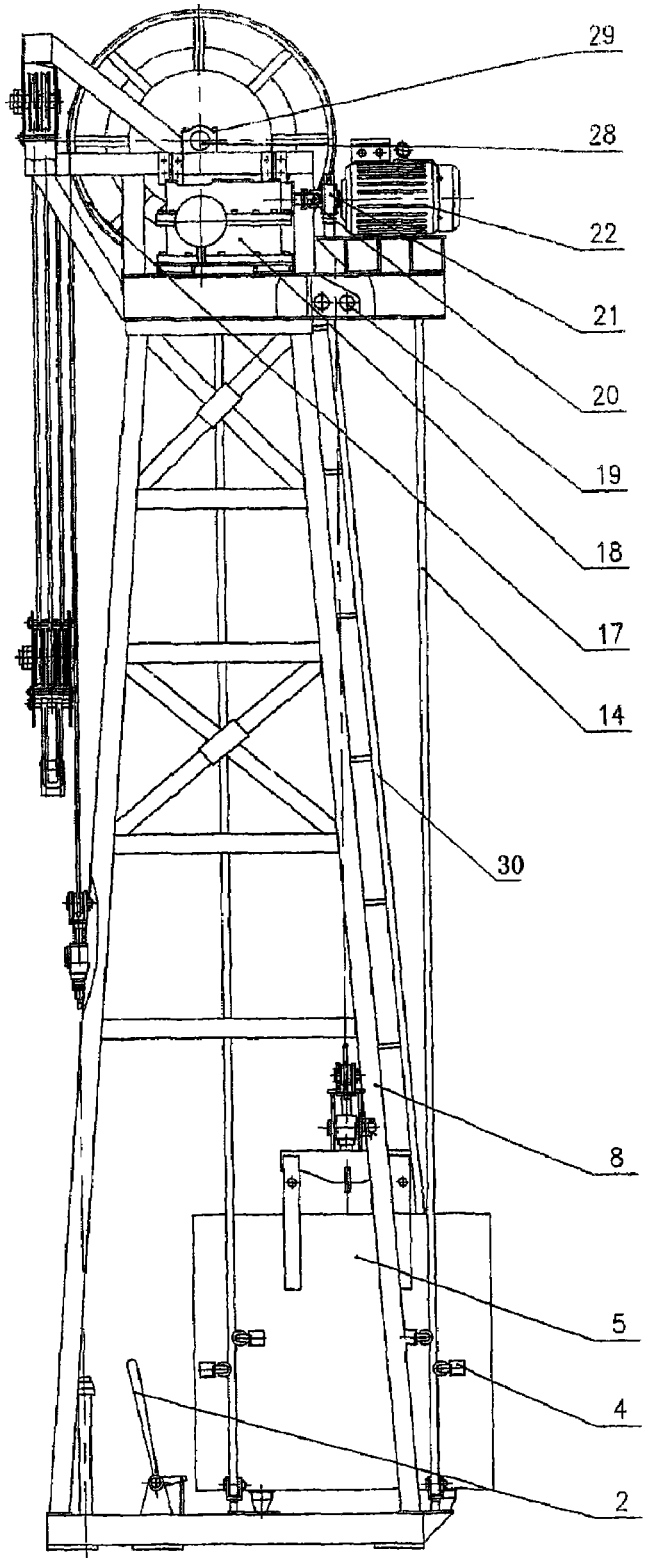
FIG. 1 is a schematic view of a configuration of a pumping and repairing unit according to the present utility model.
Figure 2:
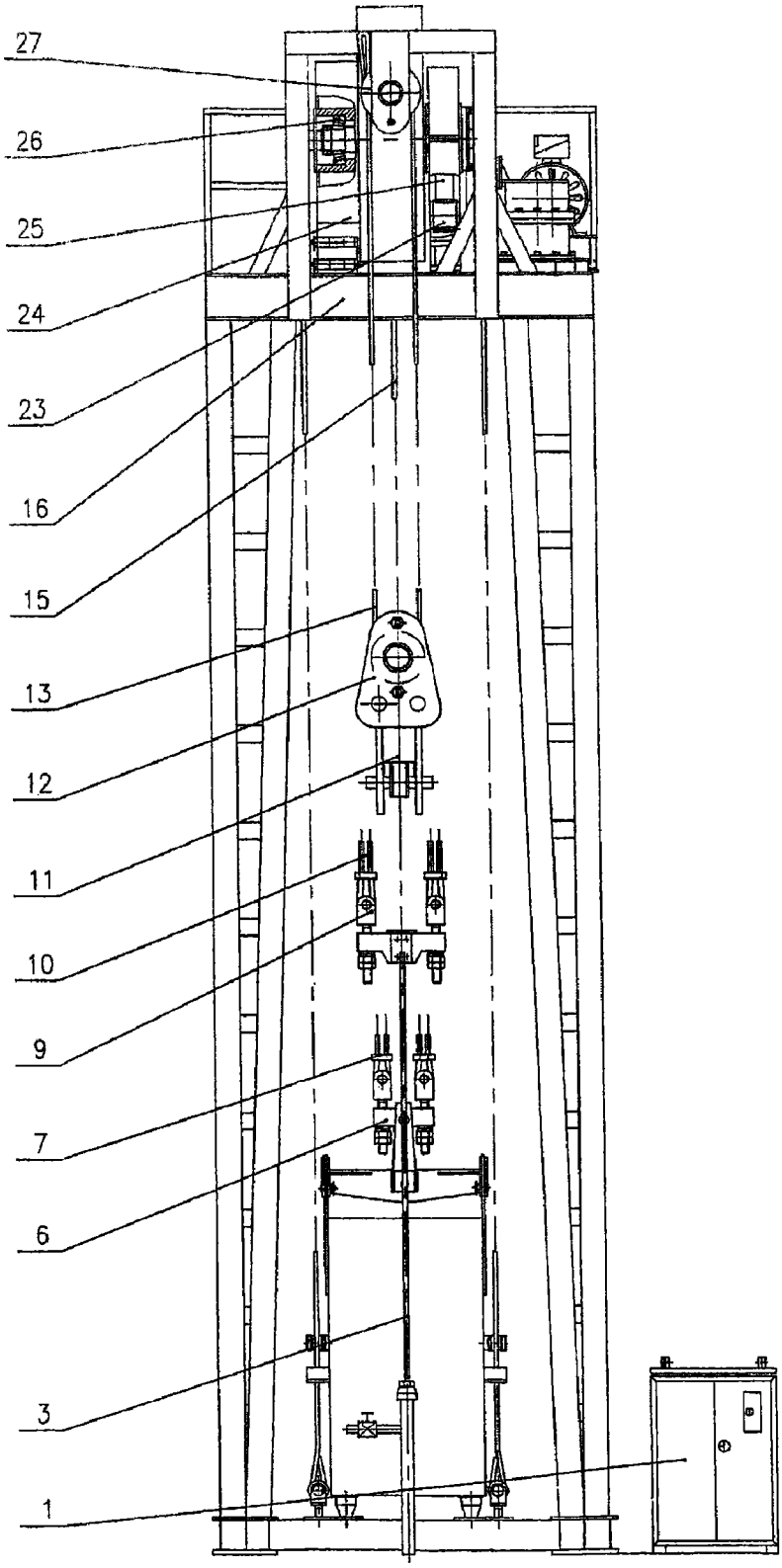
FIG. 2 is a left view of the pumping and repairing unit shown in FIG. 1.

Referring to FIGS. 1 and 2, a pumping and repairing unit according to the present invention comprises an electrical control cabinet 1, a main frame 8, a supporting platform 16, a motor 22, an electrically operated brake 21, a coupling 20, a speed reducer 18, an oil pumping polished rod 3, a rope suspension device (or a polished rod eye) 9 for the oil pumping polished rod, an oil pumping polished rod rope 10, a balance weight case 5, a balance weight rope hanging device 6, a balance weight rope 7, a protection rope 15, a protection rope catching device 19, and a driving device. The supporting platform 16 is disposed on the main frame 8. The motor 22 is coupled with the speed reducer 18 through the electrically operated brake 21 and the coupling 20. The speed reducer 18 is coupled with the driving device. The oil pumping polished rod rope 10 has an end connected with the oil pumping polished rod 3 through the rope suspension device 9 and another end fixed to the driving device. The balance weight rope 7 has an end connected with a balance weight rope hanging device 6 disposed at the balance weight case 5, and another end fixed to the driving device. The protection rope 15 has an end connected with the balance weight rope hanging device 6, and another end which is fixed to the driving device after passing through the protection rope catching device 19 disposed at the supporting platform 16. The driving device and a brake wheel 24 disposed at an end of the driving device constitute a driving and braking device. A fixed pulley block 27 is disposed at the supporting platform 16. A workover rope 13 is fixed to the driving and braking device, and has another end which is fixed to the supporting platform 16 after winding around the fixed pulley block 27 and a movable pulley block 12. A hanging connector (or an elevator) 11 is coupled with a lower end of the movable pulley block 12. A braking handle 2 is disposed at a bottom of the main frame 8. The brake wheel 24 is controlled by the braking handle 2 through a lever. Balance weight guiding ropes 14 are arranged between the bottom of the main frame 8 and the supporting platform 16. Wire ropes having a diameter of 30 mm may be used for balance weight guiding ropes 14. Upper and lower guiding wheels 4 are mounted to the balance weight case 5 so as to be staggered with respect to each other. The balance weight guiding ropes 14 are interposed between the upper and lower guiding wheels 4. The guiding wheels 4 are made of a nylon material. Therefore, a guiding configuration composed of the guiding wheels 4 does not need lubricant, does not generate noise and can increase wind force withstanding capacity of the main frame. A ladder 30 is mounted to the main frame 8. Alternatively, an elevator is mounted to the main frame 8.

Figure 3:
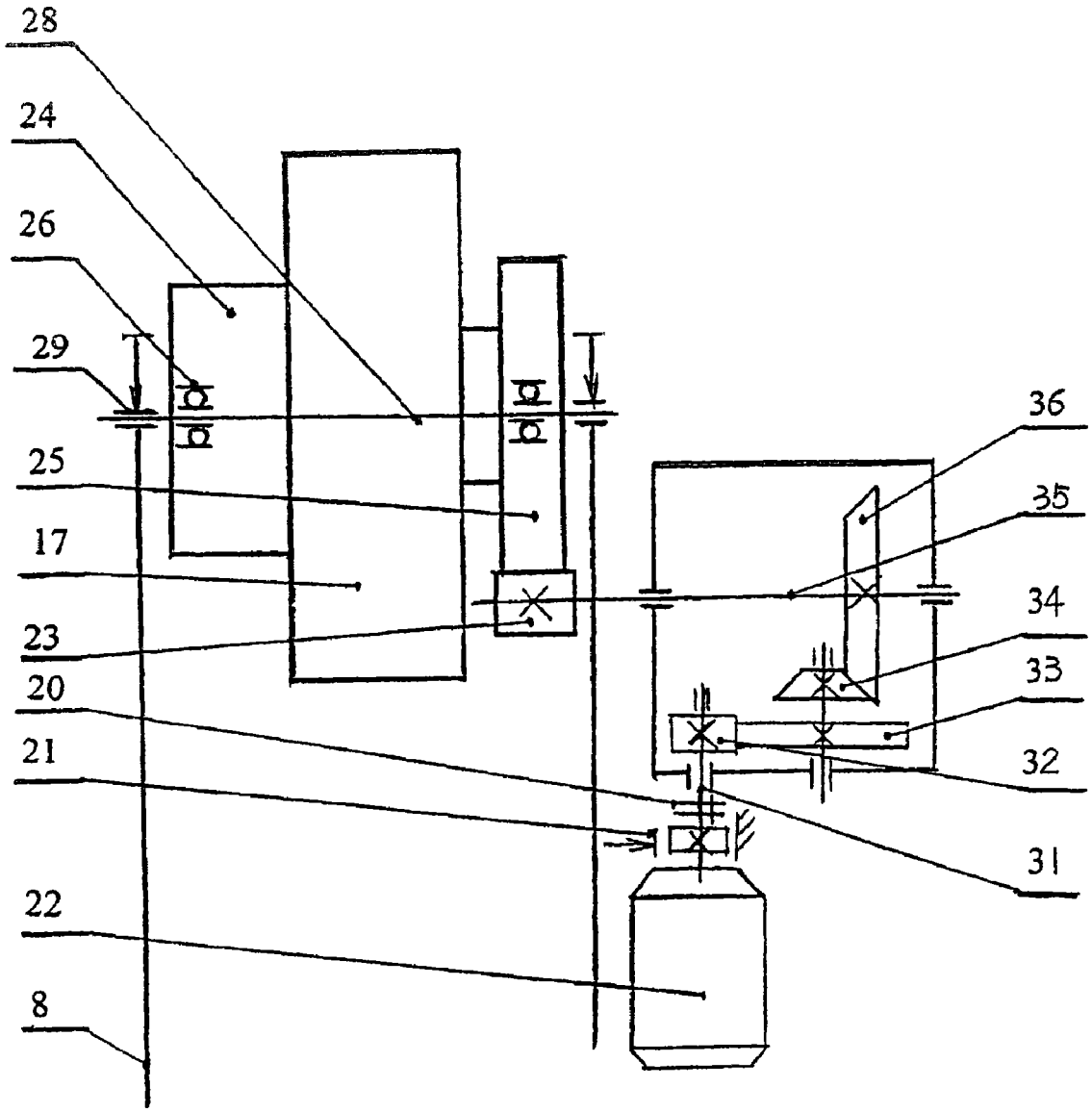
FIG. 3 is a schematic view of a configuration of a driving and braking device.

Referring to FIG. 3, the driving and braking device comprises a head sheave 17, a small gear 23, a larger gear 25, and the brake wheel 24. The small gear 23 meshes with the larger gear 25. The larger gear 25, the head sheave 17, and the brake wheel 24 are coaxially fixed to one another, and then mounted on a head sheave shaft 28 through bearings 26. The head sheave shaft 28 is fastened to the supporting platform 16 with head sheave shaft fasteners 29.

The motor 22 drives an input shaft 31 and a small cylindrical gear 32 of the speed reducer and consequently a larger cylindrical gear 33 to rotate through the electrically operated brake 21 and the coupling 20. The larger cylindrical gear 33 drives a small bevel gear 34 meshing with a larger bevel gear 36. The larger bevel gear 36 drives an output shaft 35 of the speed reducer and consequently the small gear 23 meshing with the larger gear 25. The larger gear 25 drives and rotates the head sheave 17 and the brake wheel 24.

Figure 4:
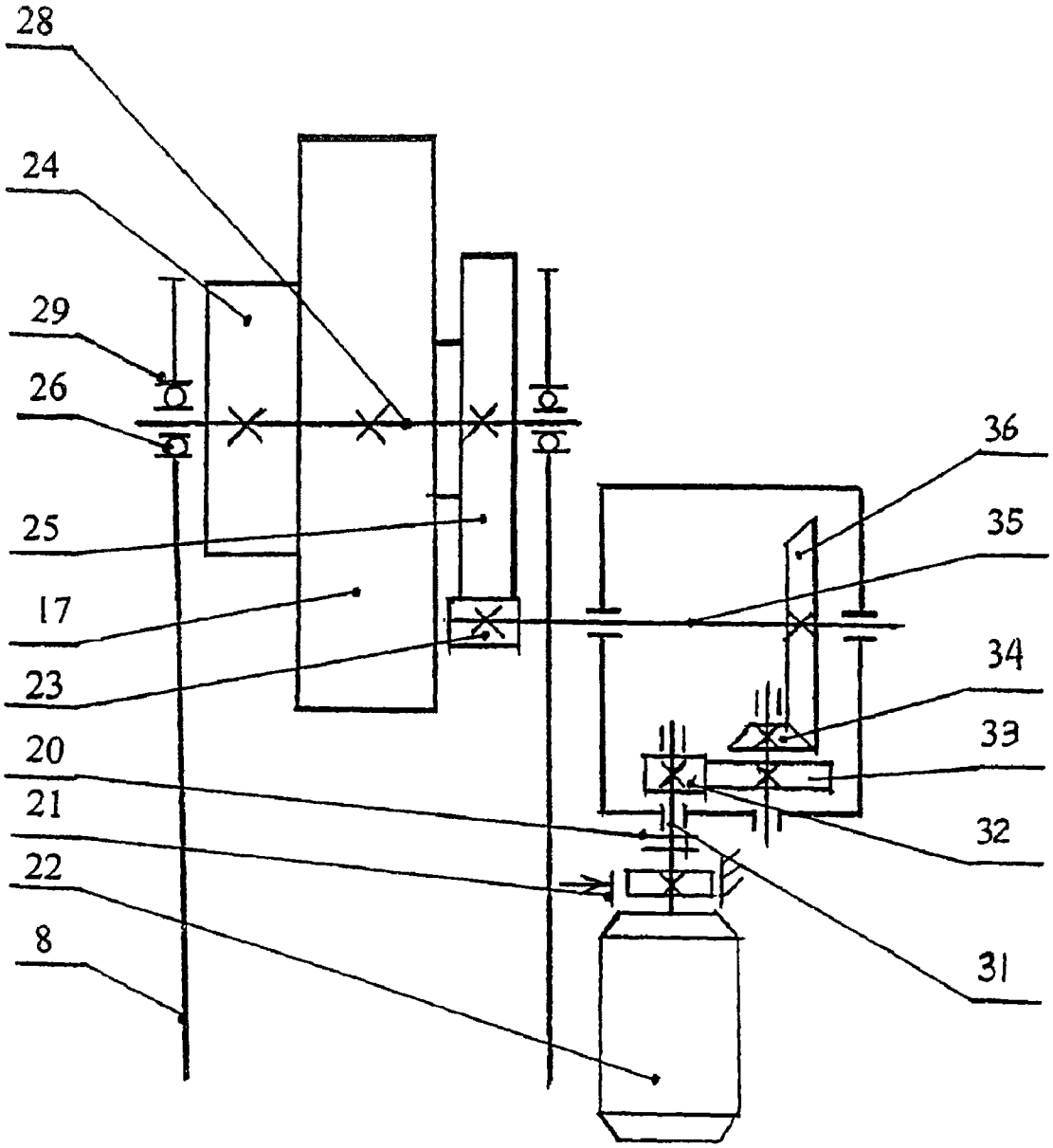
FIG. 4 is a schematic view of a configuration of another driving and braking device.

Referring to FIG. 4, the driving and braking device comprises a head sheave 17, a small gear 23, a larger gear 25, and the brake wheel 24. The small gear 23 meshes with the larger gear 25. The larger gear 25, the head sheave 17, and the brake wheel 24 are fixed to a head sheave shaft 28. The head sheave shaft 28 has two ends fastened to the supporting platform 16 through bearings 26.

The motor 22 drives an input shaft 31 and a small cylindrical gear 32 of the speed reducer and consequently a larger cylindrical gear 33 to rotate through the electrically operated brake 21 and the coupling 20. The larger cylindrical gear 33 drives a small bevel gear 34 meshing with a larger bevel gear 36. The larger bevel gear 36 drives an output shaft 35 of the speed reducer and consequently the small gear 23 meshing with the larger gear 25. The larger gear 25 drives the head sheave shaft 28 and consequently the head sheave 17 and the brake wheel 24 rotate.

The small gear 23 and the larger gear 25 may be replaced by a pin gear transmission or a chain transmission.

The motor 22 may be coupled with the speed reducer 18 through the electrically operated brake 21 and then through a belt transmission or a chain transmission.

Fillers within the balance weight case 5 may be a mixture of sand and carpolite. Such a balance weight decreases manufacturing cost by 80%-90% compared with a balance weight made of iron.

When the pumping and repairing unit is used to pump oil, the motor 22 is controlled by the electrical control cabinet 1 to regularly rotate forwardly and reversely and drives the speed reducer 18 to operate through the electrically operated brake 21 and the coupling 20. The small gear 23 disposed on the output shaft of the speed reducer 18 meshes with the larger gear 25 to rotate the larger gear 25. The head sheave 17 fastened to the larger gear 25 rotates forwardly and reversely around the head sheave shaft 28. The oil pumping polished rod rope 10 and the balance weight rope 7 are both fixed to a periphery of a drum of the head sheave 17 and drive the oil pumping polished rod 3 and the balance weight case 5 to reciprocate upwardly and downwardly, respectively. As a result, the oil pumping polished rod 3 drives an oil pump to pump oil with high efficiency.

When the pumping and repairing unit is used for workover, the balance weight case 5 is lowered onto the main frame 8. And then the oil pumping polished rod rope 10, the balance weight rope 7, and the protection rope 15 are removed. The one end of the workover rope 13 is fixed to the periphery of the drum of the head sheave 17, and the other end of the workover rope 13 is fixed to the supporting platform 16 after passing through the fixed pulley block 27 and the movable pulley block 12. Therefore, when the motor 22 rotates, the head sheave 17 winds and unwinds the workover rope 13 50 that the workover rope 13 drives the movable pulley block 12 and consequently the hanging connector 11 to move upwardly and downwardly. The hanging connector 11 clamps the oil pumping polished rod or oil pipe to pull it up, thereby achieving safe workover. The pumping and repairing unit has a very complete and reliable function of workover, and does no harm to transmission components thereof during workover. During workover, the oil pumping polished rod and the oil pipe stand beside the main frame and are surrounded by canvas or nylon cloth so that a relatively sealed space is formed. Therefore, waste is treated without environmental pollution so that the workover is environmentally-friendly. The entire process of the workover is simple and convenient in operation.

When the oil pumping polished rod 3 or the oil pumping polished rod rope 10 is separated from the head sheave 17, the motor 22 is overloaded due to loss of balance force, so that the protection rope catching device 19 is actuated to clamp the protection rope 15. As a result, the balance weight case 5 cannot fall so as to avoid any accident, and thereby all of the equipment is protected.

The invention claimed is:

1. A pumping and repairing unit, comprising:

an electrical control cabinet, a main frame, a supporting platform, a motor, an electrically operated brake, a coupling, a speed reducer, an oil pumping polished rod, a rope suspension device for the oil pumping polished rod, an oil pumping polished rod rope, a balance weight case, a balance weight rope hanging device, a balance weight rope, a protection rope, a protection rope catching device, and a driving device;

wherein the supporting platform is disposed on the main frame; the motor is coupled with the speed reducer through the electrically operated brake and the coupling; the speed reducer is coupled with the driving device; the oil pumping polished rod rope has an end connected with the oil pumping polished rod through the rope suspension device and another end fixed to the driving device; the balance weight rope has an end connected with a balance weight rope hanging device disposed at the balance weight case, and another end fixed to the driving device; the protection rope has an end connected with the balance weight rope hanging device, and another end which is fixed to the driving device after passing through the protection rope catching device disposed at the supporting platform;

a driving and braking device comprises the driving device and a brake wheel disposed at an end of the driving device; a fixed pulley block disposed at the supporting platform; a workover rope fixed to the driving and braking device, and having another end which fixed to the supporting platform after winding around the fixed pulley block and a movable pulley block; a hanging connector connected to a lower end of the movable pulley block; a braking handle disposed at a bottom of the main frame; and the brake wheel controlled by the braking handle through a lever.

2. The pumping and repairing unit according to claim 1 wherein:

the driving and braking device comprises: a head sheave, a small gear, a larger gear, and the brake wheel, wherein, the small gear meshes with the larger gear; the larger gear, the head sheave, and the brake wheel are coaxially fixed to one another, and mounted on a head sheave shaft through bearings; and the head sheave shaft is fastened to the supporting platform with head sheave shaft fasteners.

3. The pumping and repairing unit according to claim 1, wherein:

the driving and braking device comprises: a head sheave, a small gear, a larger gear, and the brake wheel, wherein, the small gear meshes with the larger gear; the larger gear, the head sheave, and the brake wheel are fixed to a head sheave shaft; and the head sheave shaft has two ends fastened to the supporting platform through bearings.

4. The pumping and repairing unit according to claim 1 wherein:

balance weight guiding ropes are arranged between the bottom of the main frame and the supporting platform; upper and lower guiding wheels are mounted to the balance weight case so as to be staggered with respect to each other; and the balance weight guiding ropes are interposed between the upper and lower guiding wheels.

5. The pumping and repairing unit according to claim 4 wherein:

a ladder is mounted to the main frame.

6. The pumping and repairing unit according to claim 1 wherein:

a ladder is mounted to the main frame.

7. The pumping and repairing unit according to claim 1 wherein:

fillers within the balance weight case are building waste, industrial waste, water, or a mixture of building waste, industrial waste, or water.

8. The pumping and repairing unit according to claim 7 wherein:

the building waste comprises sand, carpolite, clay, bricks, or concrete blocks.

9. The pumping and repairing unit according to claim 7 wherein:

the industrial waste comprises scoria, ore, or slag.

10. A pumping and repairing unit, comprising:

a supporting platform, a head sheave disposed on the supporting platform, a fixed pulley block disposed at the supporting platform, a movable pulley block, and a workover rope having an end fixed to a periphery of a drum of the head sheave, and another end which is fixed to the supporting platform after winding around the fixed pulley block and the movable pulley block, said workover rope being adapted to pull up an oil pipe or an oil pumping polished rod for workover.

11. The pumping and repairing unit according to claim 10, further comprising:

a hanging connector connected to the movable pulley block for clamping and pulling up the oil pipe or the oil pumping polished rod.

12. The pumping and repairing unit according to claim 10, further comprising:

an oil pumping polished rod rope having an end connected to the oil pumping polished rod, and another end fixed to the periphery of the drum of the head sheave, a balance weight case, and a balance weight rope having an end connected to the balance weight case, and another end fixed to the periphery of the drum of the head sheave, wherein the oil pumping polished rod rope and the balance weight rope both fixed to the periphery of the drum of the head sheave are adapted to drive the oil pumping polished rod and the balance weight case to reciprocate upwardly and downwardly, respectively.

13. The pumping and repairing unit according to claim 10, further comprising:

a protection rope having an end connected to a balance weight case, and another end which is fixed to the periphery of the drum of the head sheave after passing through the protection rope catching device disposed at the supporting platform.

14. The pumping and repairing unit according to claim 10, further comprising:

a driving and braking device, said driving and braking device comprising:

the head sheave, a small gear, a larger gear meshing with the small gear and fixed to the head sheave, and a brake wheel fixed to the head sheave.

15. The pumping and repairing unit according to claim 10, further comprising:

the main frame on which the supporting platform is disposed, balance weight guiding ropes arranged between a bottom of the main frame and the supporting platform, and upper and lower guiding wheels that are mounted to the balance weight case so as to be staggered with respect to each other, wherein the balance weight guiding ropes are interposed between the upper and lower guiding wheels.

16. The pumping and repairing unit according to claim 15, wherein:

the upper and lower guiding wheels are made of nylon.

* * * * *